US005689985A

United States Patent [19]

Chamberlain

[11] Patent Number: 5,689,985

[45] Date of Patent: Nov. 25, 1997

[54] ELECTRONIC TOUCH KEY PROVIDING A TACTILE PRESSURE SIGNAL FOR AN ELECTRONIC LOCK

[75] Inventor: L.C. Derek Chamberlain, Colorado Springs, Colo.

[73] Assignee: Schlage Lock Company, San Francisco, Calif.

[21] Appl. No.: 536,820

[22] Filed: Sep. 29, 1995

[51] Int. Cl.[6] ..... E05B 17/00

[52] U.S. Cl. ..... 70/438; 70/277; 70/408

[58] Field of Search ..... 70/413, 438, 408, 70/393, 395, 276, 277, 388, 278, DIG. 59

[56] References Cited

U.S. PATENT DOCUMENTS

| | | | |
|---|---|---|---|
| 4,312,198 | 1/1982 | Sedley | 70/395 |
| 4,366,688 | 1/1983 | Bennett | 70/395 |
| 4,440,011 | 4/1984 | Klein | 70/438 |
| 4,562,712 | 1/1986 | Wolter | 70/408 |
| 4,663,952 | 5/1987 | Gelhard | 70/278 |
| 4,868,409 | 9/1989 | Tanaka | 70/278 |
| 5,091,771 | 2/1992 | Bolan | 70/278 |
| 5,156,032 | 10/1992 | Edgar | 70/413 |
| 5,281,945 | 1/1994 | Keppner | 70/413 |
| 5,311,757 | 5/1994 | Spahn | 70/408 |
| 5,433,096 | 7/1995 | Janssen | 70/413 |
| 5,435,160 | 7/1995 | Linsalato | 70/408 |
| 5,437,174 | 8/1995 | Aydin | 70/278 |

FOREIGN PATENT DOCUMENTS

| | | | |
|---|---|---|---|
| 4141270 | 6/1993 | Germany | 70/408 |
| 2039321 | 8/1980 | United Kingdom | 70/408 |
| 2263302 | 7/1993 | United Kingdom | 70/408 |

*Primary Examiner*—Steven N. Meyers
*Assistant Examiner*—Gary Estremsky
*Attorney, Agent, or Firm*—Robert F. Palermo; Michael H. Minns

[57] ABSTRACT

An electronic touch key for operating an electronic lock in an electronic lockset, includes a handle having front and rear surfaces; an electronic touch button mounted to the front surface of the handle; and a device, mounted to the rear surface of the handle, for providing a tactile signal to the user by oil-canning when the electronic touch button has been touched to a lock with the proper force.

13 Claims, 2 Drawing Sheets

ELECTRONIC TOUCH KEY PROVIDING A TACTILE PRESSURE SIGNAL FOR AN ELECTRONIC LOCK

BACKGROUND OF THE INVENTION

This invention relates generally to electronic touch keys for electronic locksets and more particularly to an electronic key for use with a lockset, operated by both a standard key and an electronic key, which provides a signal to the user that the key has been properly applied to the lock.

Locksets operated by both a standard key and an electronic key are becoming more common in the door hardware industry. Increasingly, the electronic key employed is a touch key, which operates the locking mechanism by merely touching the key to an electronic sensor on the lockset. Typically, an electronic lockset provides either an audible and/or visible signal that the touch key has been properly applied. This type of signal, however, requires electrical power for its operation. For battery powered electronic locks, this power requirement causes excessive drainage and leads to premature failure of the battery.

Without some indication that the key has been properly applied, a user has no way of knowing whether he has an improper key; whether the lock is inoperative; or whether he has merely applied the key improperly. Such uncertainty deprives one of ingress to the secured area, results in inconvenience and frustration, and may even contribute to damage to the door hardware.

The foregoing illustrates limitations known to exist in present electronic touch keys. Thus, it would clearly be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing an electronic touch key for operating an electronic lock in an electronic lockset, including a key handle having front and rear surfaces an electronic touch button mounted to the front surface of the key handle and means, mounted to the rear surface of the key handle, for providing a tactile signal when the electronic touch button has been touched to a lock with the proper force.

The foregoing and other aspects will become apparent from the following detailed description of the invention when considered in conjunction with the accompanying drawings.

DETAILED DESCRIPTION

Figure 1:
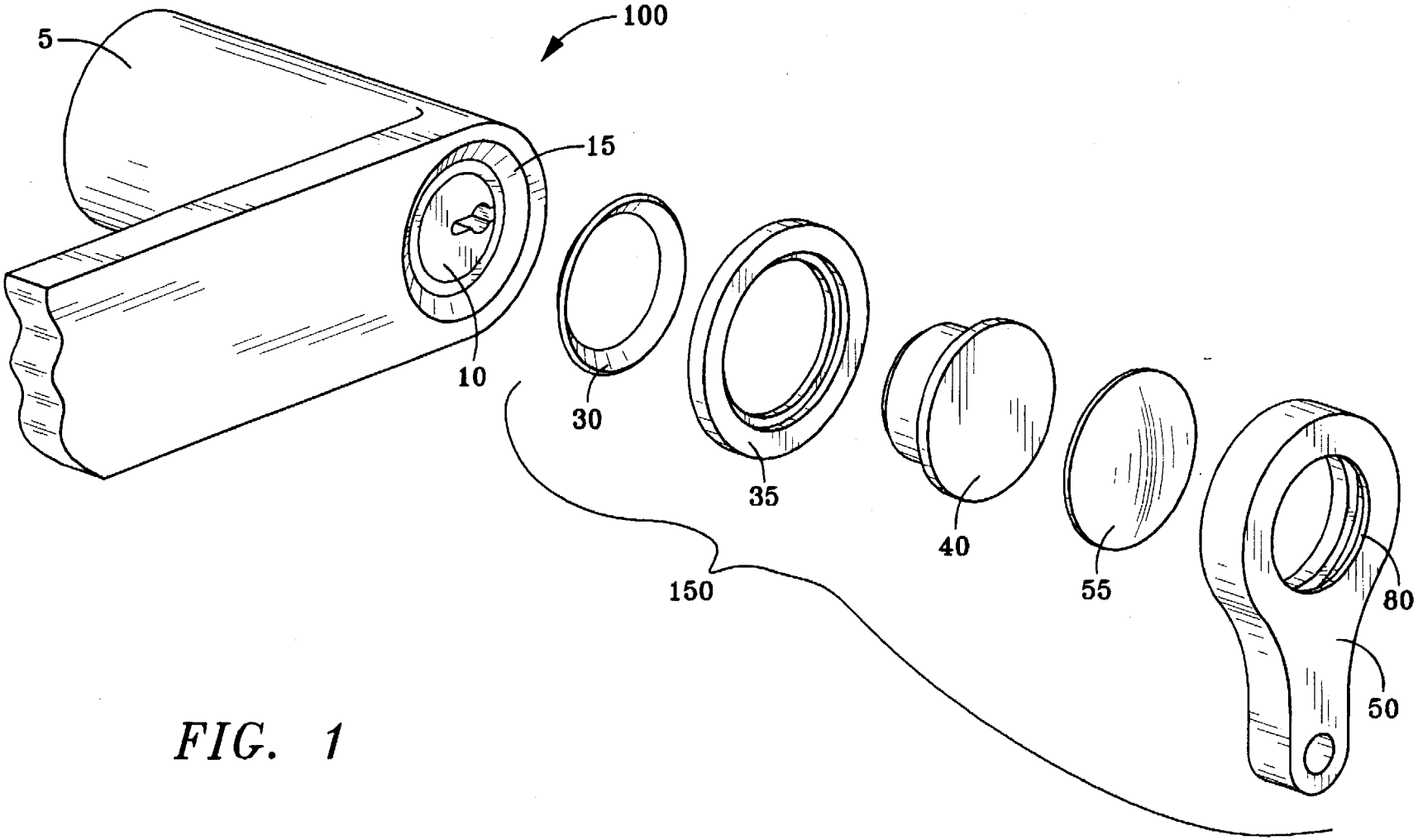
FIG. 1 is an exploded perspective view showing an electronic touch key related to a door lockset in a fragmentary door handle.

FIG. 1 shows a key cylinder 10 portion of a lockset 100 mounted in a lever handle 5 of a door. The key cylinder 10 is the type that can be operated by either a standard mechanical key or an electronic touch key. An electronic touch key 150, which, according to the invention, comprises a key handle 50, an electronic touch button 40, and a tactile signal device 55, is shown in exploded perspective near the lockset 100.

In this embodiment, key handle 50 is designed as a key fob and is shown with a small hole (not numbered) for a key chain or key ring in addition to the circular through-hole 80 in which the touch button 40 is to be mounted. Clearly, the shape of the key handle 50 is only limited by the wishes of the designers, such that key handles could be made in the shapes of cartoon characters, landmarks, logos, or virtually any shape amenable to forming. The hole 80 is preferably formed as a circle to take advantage of the benefits of circular symmetry in procurement of parts and in assembly.

The invention is best understood by reference to all Figures, as appropriate. Thus, FIGS. 1, 2*a*, and 2*b* apply to descriptions of embodiments incorporating through-holes 80, while FIGS. 1 (except for hole 80) and 2*c* apply to embodiments having blind holes 90.

Touch button 40 has a lip 42 at its rear face for securing it in hole 80, 90 of the key fob handle 50, 60. The button 40 is secured by either staking or rolling the front of key handle 50 at the edge of hole 80, 90 to form an upset lip 52 of some base material of the key handle 50, 60 to capture lip 42 of the button and to thereby retain the button 40 in the hole 80, 90 of key handle 50, 60. In the through-hole embodiments, the spring diaphragm 55 is mounted behind the touch button 40, with its convex surface facing away from the touch button and is held in place by button 40 within the hole 80.

A retaining ring 35, which has a press fit in hole 80, 90 can also be used for retaining the touch button 40 and, when present, spring diaphragm 55 in hole 80, 90. A conical centering washer 30, which is press fitted over the forward face of touch button 40 and which grips against the lateral surface of the button, coacts with the conical recess 15 surrounding the lock 10 in lever 5 to assist in centering and aligning the touch key 150 with the lock 10, in use. This centering feature may be included or excluded from any embodiment, depending on whether other alignment aids are present.

Figure 2:
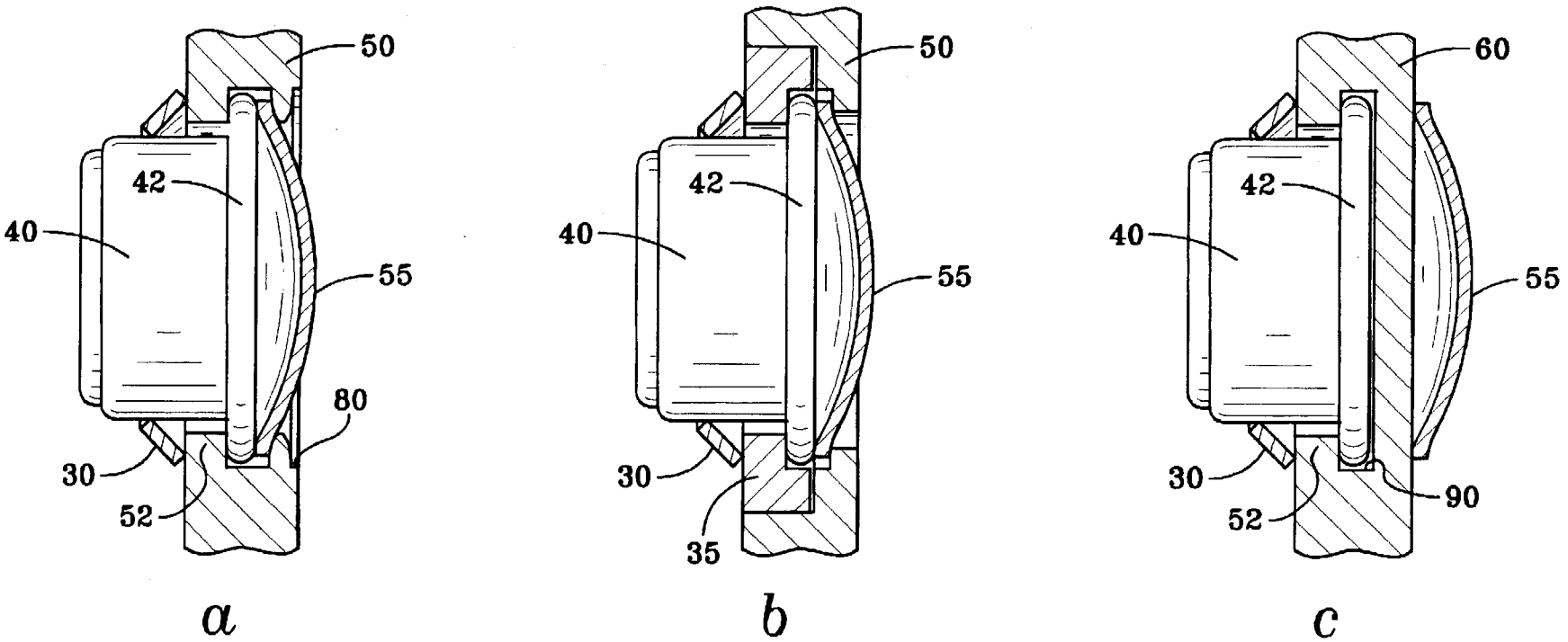
FIGS. 2*a*, 2*b*, and 2*c* show three embodiments of the invention with examples of assembly options.

In the blind hole 90 embodiment of FIG. 2*c*, spring diaphragm 55 is attached to the rear surface of the key handle 60 by using adhesives, ultrasound, or other commonly used and well known methods for joining materials. Except for the additional height of the spring diaphragm 55 above the rear surface of the key handle 60, there is no functional difference between the embodiments of the electronic touch key 150 shown.

When the face (touch button 40) of the touch key 150 is applied to the signal target (lock 10), a light force on the spring diaphragm 55 will cause the spring diaphragm to invert and change from convex to flat or concave. This change, referred to commonly as "oil canning", will be felt by the user as a gentle pulse against his finger, and he will be aware that he has properly applied the touch key 150 to lock 10. Upon removal of the contact force, the spring diaphragm 55 resumes its convex shape and is ready for the next use. Note that there is usually a slight audible sound emitted when the spring diaphragm oil cans in either direction which may also help notify the user that he has properly applied the touch key.

Selection of the type and thickness of the material for the spring diaphragm 55 determines the amount of force required to cause oil canning action and the magnitude of the tactile signal (and audible signal) resulting from the action. Of course, the higher the force of application becomes, the more certain one is that proper contact has been made, but that certainty comes at the cost of more rapid wear to the lock 10 and the touch key 150. In any case, the touch key 150 provides its signal of proper application to the lock without consumption of any electrical power.

The centering washer 30 has a conical form in order to be congruent with the conical recess 15 of the lockset 100 and to readily guide the touch button 40 of touch key 150 into a properly centered registration with the signal target in lock 10. This is especially useful in cases where visibility of the lock 10 is limited due to darkness or other causes.

Having described the invention, what is claimed is:

1. An electronic touch key for operating an electronic lock in an electronic lockset, comprising:

a key handle having front and rear surfaces;

an electronic touch button mounted to the front surface of said key handle, for touching and operating an electronic lock as the key handle is moved toward the lock with said front surface facing the electronic lock; and means, mounted to the rear surface of said key handle, for providing a tactile signal when said electronic touch button has been touched to a lock with a proper force, the means for providing a tactile signal comprising a convex spring diaphragm mounted with its convex surface facing outward from the rear surface of said key handle.

2. The electronic touch key of claim 1, further comprising:

a hole in said key handle from the front surface to the rear surface, said electronic touch button being mounted within the hole and protruding from the front surface thereof.

3. The electronic touch key of claim 2, wherein said convex spring diaphragm is mounted within said hole.

4. The electronic touch key of claim 1, further comprising:

means for guiding said touch key to a centered position of registration against said lock.

5. An electronic touch key for operating an electronic lock in a lockset, comprising:

a key handle having a hole of a certain shape;

an electronic touch button having a shape, congruent to the certain shape of the hole in said handle, and mounted within said hole such that one face of said electronic touch button protrudes above a surface of said key handle and may be pressed against a lock; and a convex spring diaphragm mounted to said key handle, on the surface of said key handle opposite that from which said electronic touch button protrudes, said spring diaphragm oil-canning to provide a tactile signal to a user, said signal indicating adequate touch force as said touch button is pressed against a lock.

6. The electronic touch key of claim 5, wherein the certain shape of the hole in said key handle comprises a circle.

7. The electronic touch key of claim 6, wherein the hole in said key handle is a through hole, and the convex spring diaphragm is mounted in said hole in said key handle, behind said electronic touch button, with its convex surface facing away from said electronic touch button.

8. The electronic touch key of claim 7, further comprising:

means for guiding said touch key to a centered position of registration against said lock.

9. The electronic touch key of claim 5, further comprising:

means for guiding said touch key to a centered position of registration against said lock.

10. An electronic touch key for operating an electronic lock in a lockset when a portion of said key is pressed against the lock, said key comprising:

a key handle having an opening therein;

an electronic touch button for contacting a lock, said touch button being disposed in said opening; and, a flexible spring diaphragm mounted on said key handle, said diaphragm being disposed on said key handle in alignment with said touch button so that application of a manual force by a finger of a user tending to press said touch button against a lock causes said diaphragm to suddenly change state upon application of a predetermined manual force thereby providing a tactile pressure signal to the user's finger that the touch button has been pressed against the lock with sufficient force to cause operation of the lock.

11. An electronic touch key as claimed in claim 10 wherein said opening is a blind hole extending into a front surface of said key handle and said spring diaphragm is mounted on a rear surface of said key handle.

12. An electronic touch key as claimed in claim 10 wherein said opening extends through said key handle from a front surface to a rear surface thereof, said diaphragm spring and said touch button being captured in said opening.

13. An electronic lock as claimed in claim 10, wherein said spring diaphragm is dome-shaped and has a convex side facing away from said touch button.

* * * * *